US009200543B2

(12) United States Patent
Yamaguchi et al.

(10) Patent No.: US 9,200,543 B2
(45) **Date of Patent: *Dec. 1, 2015**

(54) VARIABLE VALVE TIMING DEVICE

(75) Inventors: Ichiro Yamaguchi, Toyota (JP); Yuu Yokoyama, Okazaki (JP); Haruhito Fujimura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/115,493

(22) PCT Filed: May 13, 2011

(86) PCT No.: PCT/JP2011/061071

§ 371 (c)(1),
(2), (4) Date: Nov. 4, 2013

(87) PCT Pub. No.: WO2012/157045

PCT Pub. Date: Nov. 22, 2012

(65) Prior Publication Data

US 2014/0069363 A1 Mar. 13, 2014

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34459* (2013.01); *F01L 2001/34469* (2013.01); *F01L 2250/02* (2013.01); *F01L 2800/00* (2013.01); *F01L 2800/05* (2013.01)

(58) Field of Classification Search
CPC ..... F01L 1/344; F01L 1/3442; F01L 2001/34459; F01L 2800/05
USPC ..... 123/90.15, 90.17
See application file for complete search history.

(56) References Cited

U.S. PATENT DOCUMENTS 6,505,586 B1 1/2003 Sato et al.
7,100,554 B2 9/2006 Hirowatari et al.
8,297,245 B2 10/2012 Urushihata (Continued)

FOREIGN PATENT DOCUMENTS

EP 2 474 713 A1 7/2012
GB 2 385 889 A 9/2003

(Continued)

OTHER PUBLICATIONS

Jan. 2, 2015 Notice of Allowance issued in U.S. Appl. No. 13/519,370.

(Continued)

*Primary Examiner* — Ching Chang
(74) *Attorney, Agent, or Firm* — Oliff PLC

(57) ABSTRACT

In a variable valve timing device, which varies the rotational phase of a camshaft through the relative rotation of a vane rotor and a housing and is provided with a lock mechanism that releases the lock thereof in response to the application of lock-release hydraulic pressure, the crank angle CCA at which the application of lock-release hydraulic pressure is commanded is set variably in accordance with the pressure of the oil supplied for the application so that the lock-release hydraulic pressure rises at a crank angle at which the state of the cam torque becomes suitable for lock-release without relying on changes of time needed for the lock-release hydraulic pressure to raise resulting from oil temperature.

4 Claims, 4 Drawing Sheets

(56) References Cited

U.S. PATENT DOCUMENTS

| | | | |
|---|---|---|---|
| 2010/0269772 | A1 | 10/2010 | Takemura et al. |
| 2010/0305835 | A1 | 12/2010 | Inoue et al. |
| 2011/0162606 | A1 | 7/2011 | Kaneko |
| 2013/0213326 | A1 | 8/2013 | Fujimura et al. |
| 2014/0069359 | A1 | 3/2014 | Hayashida et al. |

FOREIGN PATENT DOCUMENTS

| | | | |
|---|---|---|---|
| JP | A-2001-041012 | | 2/2001 |
| JP | A-2001-050064 | | 2/2001 |
| JP | A-2003-172110 | | 6/2003 |
| JP | A-2005-076518 | | 3/2005 |
| JP | A-2007-153212 | | 6/2007 |
| JP | A-2007-255258 | | 10/2007 |
| JP | A-2009-24563 | | 2/2009 |
| JP | A-2010-209780 | | 9/2010 |
| JP | A-2010-275911 | | 12/2010 |
| JP | A-2011-038446 | | 2/2011 |
| WO | WO 2012/063312 | A1 | 5/2012 |

OTHER PUBLICATIONS

Sep. 2, 2014 Office Action issued in U.S. Appl. No. 13/519,370.

Aug. 3, 2015 Notice of Allowance issued in U.S. Appl. No. 13/519,370.

Oil Temperature: Low

Oil Temperature: High

VARIABLE VALVE TIMING DEVICE

TECHNICAL FIELD

The present invention relates to a variable valve timing device that varies the rotational phase of a camshaft through relative rotation of first and second rotary bodies, and includes a lock mechanism, which locks the first and second rotary bodies to rotate integrally with each other, and releases the lock in response to application of a lock-release hydraulic pressure.

BACKGROUND ART

As is publicly known, a variable valve timing device, which is a device to be applied to an internal combustion engine mounted on a vehicle, has been put to a practical use. The variable valve timing device varies the rotational phase of a camshaft, more specifically the rotational phase of the camshaft relative to a crankshaft, which is an engine output shaft, to set the valve timing of engine valves (intake and exhaust valves) variably. A hydraulic variable valve timing device that operates based on a hydraulic pressure as disclosed in each of Patent Documents 1 and 2 is known as such a variable valve timing device.

With reference to FIG. 3, a configuration of the variable valve timing device as disclosed in each of Patent Documents 1 and 2 will be described.

As shown in FIG. 3, a vane rotor 2 provided with a plurality of (in FIG. 3, three) vanes 3, which protrude outward in a radial direction, is fixed to a camshaft 1 such that the vane rotor 2 and the camshaft 1 rotate integrally with each other. A substantially annular housing 4 is arranged on an outer periphery of the vane rotor 2 to be rotational relative to the vane rotor 2. A cam sprocket 5, which is operably connected through a chain to a crankshaft of an internal combustion engine, is fixed to the housing 4 so that the cam sprocket 5 and the housing 4 rotate integrally with each other. Recesses 6, the number of which is the same as that of the vanes 3, are formed in an inner periphery of the housing 4. Each vane 3 is accommodated in one of the recesses 6. Each recess 6 in the housing 4 is partitioned into two oil chambers, namely a retard chamber 7 and an advance chamber 8 by the vane 3 accommodated therein. The retard chamber 7 is located on the leading side in the rotational direction of the camshaft with respect to the vane 3. In contrast, the advance chamber 8 is located on the trailing side in the rotational direction of the camshaft with respect to the vane 3.

The variable valve timing device also includes a lock mechanism, which locks the vane rotor 2 and the housing 4 such that the vane rotor 2 and the housing 4 rotate integrally with each other. The lock mechanism has a lock pin 10 that slides in a pin hole 9 formed in one of the vanes 3 of the vane rotor 2, and a lock hole 11 formed in the cam sprocket 5. The lock pin 10 can be received in the lock hole 11. The lock pin 10 is urged in a direction in which the lock pin 10 is received in the lock hole 11 by a spring 12. The lock pin 10 is arranged at a position in a rotational range of the vane rotor 2 relative to the housing 4 in which the vane rotor 2 is relatively rotated in the direction opposite to the rotational direction of the camshaft at most (hereinafter, referred to as a most retarded position), and the lock pin 10 is received in the lock hole 11.

In contrast, a hydraulic circuit, which supplies and discharges a hydraulic pressure for operating the variable valve timing device, is provided in the variable valve timing device. In the hydraulic circuit, an oil pump 14 pressurizes oil pumped from an oil pan 13, and discharges the oil to a main gallery 21 formed in a cylinder block. A hydraulic sensor 22, which detects a hydraulic pressure in the main gallery 21, is installed on the main gallery 21.

The main gallery 21 is connected through a supply oil passage 15 to an oil control valve (hereinafter, referred to as OCV 16). The OCV 16 is configured as an electromagnetic valve controlled by an electronic control unit for engine control (hereafter, referred to as ECU 20). In addition to the above-described supply oil passage 15, a drain oil passage 17 for returning the oil to the oil pan 13, a retard oil passage 18 connected to each retard chamber 7, and an advance oil passage 19 connected to each advance chamber 8 are connected to the OCV 16. The OCV 16 is configured to supply and discharge the oil to and from the retard chamber 7 and the advance chamber 8 by switching the connection of any one of the supply oil passage 15 and the drain oil passage 17 to each of the retard oil passage 18 and the advance oil passage 19.

The hydraulic pressure supplied to the retard chamber 7 and the advance chamber 8 also acts on the lock pin 10. The hydraulic pressure acts in the direction in which the lock pin is drawn out of the lock hole 11 against the urging force of the spring 12.

Next, an operation of such a variable valve timing device will be described.

When the ECU 20 as a control section commands the OCV 16 such that the supply oil passage 15 and the advance oil passage 19 are connected to each other, and the drain oil passage 17 and the retard oil passage 18 are connected to each other, the hydraulic pressure in the advance chamber 8 is increased, and the hydraulic pressure in the retard chamber 7 is reduced. Accordingly, force in the rotational direction of the camshaft (hereinafter, referred to as an advance direction) acts on the vane 3 due to the difference between the hydraulic pressures in the retard and advance oil chambers so that the vane rotor 2 rotates in the advance direction relative to the housing 4. As a result, the rotational phase of the camshaft 1 fixed to the vane rotor 2 in an integrally rotational manner is advanced with respect to the rotational phase of the cam sprocket 5 so that the valve timing of an engine valve driven to be opened and closed by the camshaft 1 is advanced.

When the ECU 20 commands the OCV 16 to connect the supply oil passage 15 and the retard oil passage 18 to each other, and connect the drain oil passage 17 and the advance oil passage 19 to each other, the hydraulic pressure in the retard chamber 7 is increased, and the hydraulic pressure in the advance chamber 8 is reduced. Accordingly, force in the direction opposite to the rotational direction of the camshaft (hereinafter, referred to as a retard direction) acts on the vane 3 due to the difference between the hydraulic pressures in the retard chamber 7 and the advance chamber 8 so that the vane rotor 2 rotates in the retard direction relative to the housing 4. As a result, the rotational phase of the camshaft 1 fixed to the vane rotor 2 in an integrally rotational manner is retarded with respect to the rotational phase of the cam sprocket 5 so that the valve timing of the engine valve driven to be opened and closed by the camshaft 1 is retarded.

In contrast, when the ECU 20 commands the OCV 16 to stop the supply and the discharge of the oil to and from both the retard oil passage 18 and the advance oil passage 19, the vane rotor 2 stops at a position at which the hydraulic pressure in the retard chamber 7 and the hydraulic pressure in the advance chamber 8 are balanced with each other. Accordingly, the valve timing of the engine valve at this time is maintained constant.

When the engine is started, the vane rotor 2 is arranged at the most retarded position. The vane rotor 2 is in the state where the lock pin 10 is received in the lock hole 11 so that the vane rotor 2 is locked at the most retarded position in the rotational manner integrally with the housing 4.

After the engine is started, when the engine rotation speed is increased so that the discharge pressure of the oil pump 14 is sufficiently increased, the ECU 20 commands the OCV 16 to connect the supply oil passage 15 and the advance oil passage 19 to each other to supply the hydraulic pressure to the advance chamber 8. The hydraulic pressure supplied to the advance chamber 8 at this time also acts on the lock pin 10 so that the lock pin 10 exits the lock hole 11 by the hydraulic pressure. As a result, the lock of the lock mechanism is released so that the relative rotation of the vane rotor 2 and the housing 4 is permitted. Accordingly, the initial command of the supply of the hydraulic pressure to the advance chamber 8 by the ECU 20 after the engine is started is equivalent to a command of applying the lock-release hydraulic pressure for releasing the lock of the lock mechanism.

PRIOR ART DOCUMENTS

Patent Documents

Patent Document 1: Japanese Laid-Open Patent Publication No. 2001-041012

Patent Document 2: Japanese Laid-Open Patent Publication No. 2005-076518

SUMMARY OF THE INVENTION

Problems that the Invention is to Solve

The cam torque of the camshaft 1 acts on the vane rotor 2 of the variable valve timing device. That is, when the engine valve opens, it is necessary to press down the engine valve by the cam of the camshaft 1 against the valve spring, which urges the engine valve in the valve closing direction. Accordingly, torque in the direction opposite to the rotational direction of the camshaft, namely torque in the retard direction acts on the camshaft 1 and the vane rotor 2 fixed thereon in the integrally rotational manner. In contrast, when the engine valve closes, the cam is pressed by the valve spring so that torque in the rotational direction of the camshaft, namely torque in the advance direction acts on the camshaft 1 and the vane rotor 2. Therefore, the torque in the advance direction and the torque in the retard direction alternately act on the vane rotor 2 in accordance with the opening and closing action of the engine valve by the camshaft 1.

The cam torque has a considerable influence on the releasing performance of the lock mechanism. That is, the force by the hydraulic pressure of the advance chamber 8 and the force by the cam torque act on the vane rotor 2 at the time of the lock-release. When the lock pin 10 in the state shown in FIG. 4(*a*) is about to be drawn out of the lock hole 11, if the force in the advance direction by the hydraulic pressure of the advance chamber 8 and the cam torque becomes greater than or equal to some extent, the vane rotor 2 is rotated in the advance direction as shown in FIG. 4(*b*). In such a case, as shown in FIG. 4(*c*), the lock pin 10 is caught by an edge B of the lock hole 11 in the advance direction so that the lock pin 10 cannot be drawn out of the lock hole 11. As a result, the start of the variable control of the valve timing of the engine valve by permitting the relative rotation of the vane rotor 2 and the housing 4 is delayed.

In the case where the locking is performed at a position other than the most retarded position, the lock releasing characteristics change in accordance with the state of the cam torque at the time of the lock-release in a similar manner. Such a problem is caused in the similar manner even in a variable valve timing device in which the locking is performed at a position other than the most retarded position.

An object of the present invention is to provide a variable valve timing device in which release of the lock is more reliable.

Means for Solving the Problems

To achieve the above described object, a variable valve timing device that varies a rotational phase of a camshaft through a relative rotation of first and second rotary bodies is provided. The variable valve timing device includes a lock mechanism, which locks the first and second rotary bodies to rotate integrally with each other, and releases the lock in response to application of a lock-release hydraulic pressure. A crank angle at which the application of the lock-release hydraulic pressure is commanded is set variably in accordance with a temperature of an oil supplied for the application.

As described above, the releasing characteristics of the lock change depending on the state of the cam torque when the lock is released. Accordingly, to ensure the lock-release, it is desirable that the lock-release be performed at a crank angle at which the cam torque is in the state suitable for the lock-release.

In contrast, even if the application of the lock-release hydraulic pressure is commanded, a certain delay is observed until the lock-release hydraulic pressure is actually raised to start the lock-release. Time from when the command of the application of the lock-release hydraulic pressure is made until the lock-release hydraulic pressure is raised is changed in accordance with the temperature of the oil supplied for the application of the lock-release hydraulic pressure. For example, when the temperature of the oil is high, the viscosity thereof is reduced so that the supply of the lock-release hydraulic pressure is performed quickly. Accordingly, time necessary to raise the lock-release hydraulic pressure becomes shorter. Accordingly, to release the lock at a crank angle at which the cam torque is in the state suitable for the lock-release, it is necessary to set a crank angle at which the application of the lock-release hydraulic pressure is commanded in accordance with the temperature of the oil.

In this regard, in the present invention, the crank angle at which the application of the lock-release hydraulic pressure is commanded is set variably in accordance with the temperature of the oil supplied to the application. Therefore, even if the time from when the command of the application of the lock-release hydraulic pressure is made until the lock-release hydraulic pressure is raised is changed in accordance with the temperature of the oil, the lock-release hydraulic pressure is raised at an appropriate crank angle. Therefore, according to the present invention, the lock-release is ensured to be performed.

In the case where the crank angle at which the lock-release hydraulic pressure is raised is desired to be constant, when the temperature of the oil is high, the crank angle at which the application of the lock-release hydraulic pressure is commanded may be retarded in comparison to the case where the temperature is lower.

To achieve the above described object, a variable valve timing device that sets a valve timing of an engine valve variably through a relative rotation of first and second rotary bodies is provided. The variable valve timing device includes a lock mechanism, which locks the first and second rotary bodies to rotate integrally with each other, and releases the lock in response to application of a lock-release hydraulic pressure. A crank angle at which the application of the lock-release hydraulic pressure is commanded is set variably in accordance with a pressure of an oil supplied for the application.

As described above, the time from when the command of the application of the lock-release hydraulic pressure is made until the lock-release hydraulic pressure is raised is changed in accordance with the temperature of the oil supplied for the application of the lock-release hydraulic pressure. The pressure of the oil is changed depending on the temperature of the oil. Accordingly, the pressure of the oil may be used as an index value of the temperature of the oil. Accordingly, even if the crank angle at which the application of the lock-release hydraulic pressure is commanded is set in accordance with the pressure of the oil supplied for the application of the lock-release hydraulic pressure, the lock-release hydraulic pressure may be raised at an appropriate crank angle. Therefore, according to the present invention, the lock-release is ensured to be performed.

In the case where the crank angle at which the lock-release hydraulic pressure is raised is desired to be constant, when the pressure of the oil is high, the crank angle at which the application of the lock-release hydraulic pressure is commanded may be retarded in comparison to the case where the pressure is lower.

BRIEF DESCRIPTION OF THE DRAWINGS

FIG. 2(*b*) is a time chart illustrating a control manner when the lock is released in the case where the oil temperature is low;

MODES FOR CARRYING OUT THE INVENTION

Figure 1:
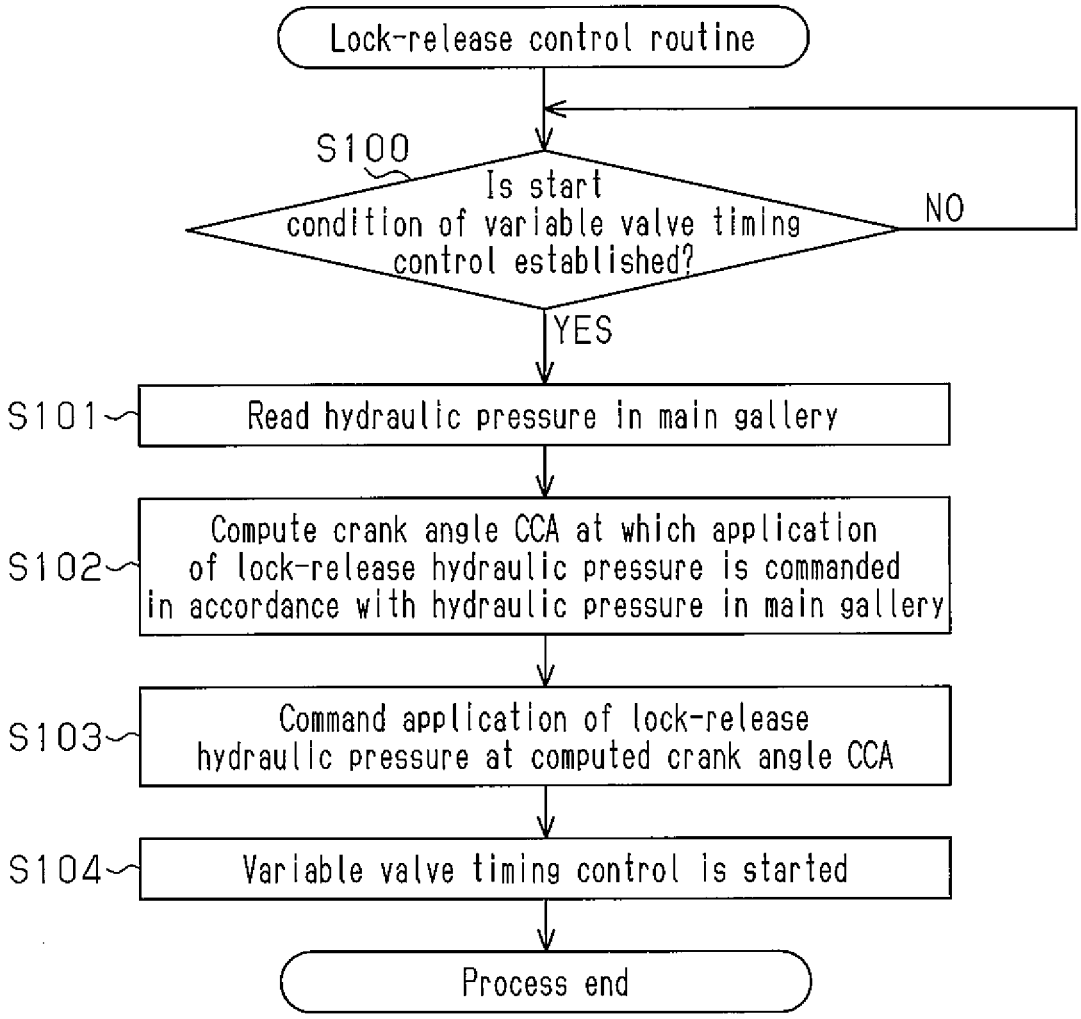
FIG. 1 is a flowchart of a lock-release control routine applied to an embodiment of the present invention.

Hereinafter, a variable valve timing device according to an embodiment of the present invention will be described with reference to FIGS. 1 and 2. The variable valve timing device of the present embodiment is configured such that the valve timing of an intake valve is set variably. The configuration of the variable valve timing device is basically the same as that of a variable valve timing device shown in FIG. 3. That is, the variable valve timing device of the present embodiment is configured such that the rotational phase of the camshaft 1 is varied in accordance with the relative rotation of the vane rotor 2 as a first rotary body and the housing 4 as a second rotary body to set the valve timing of the intake valve variably. The variable valve timing device is provided with a lock mechanism, which locks the vane rotor 2 and the housing 4 such that the vane rotor 2 and the housing 4 rotate integrally with each other, and releases the lock in response to the application of the lock release hydraulic pressure.

The ECU 20 of the variable valve timing device of the present embodiment controls the OCV 16 according to a duty control. That is, the ECU 20 commands a duty command value DUTY that takes a value in the range of −100% to +100% to the OCV 16 to control the operation of the OCV 16. When the duty command value DUTY is a positive value, the OCV 16 operates to supply the oil to the advance chamber 8. In contrast, when the duty command value DUTY is a negative value, the OCV 16 operates to supply the oil to the retard chamber 7. The amount of supply of the oil to each chamber is increased as the absolute value of the duty command value DUTY becomes greater.

When the engine is stopped, the ECU 20 rotates the vane rotor 2 to the most retarded position, and locks the relative rotation of the vane rotor 2 and the housing 4 by fitting the lock pin 10 into the lock hole 11. Accordingly, when the engine is started, the vane rotor 2 is in the state where it is located at the most retarded position and locked by the lock mechanism.

After the engine is started, when the engine rotation speed is increased to a prescribed value, and a starting condition of the variable valve timing control is established, the ECU 20 commands the duty command value of 100% to the OCV 16 to supply the oil to the advance oil passage 19 and apply the lock-release hydraulic pressure to the lock pin 10 to release the lock of the lock mechanism.

As described above, the releasing characteristics of the lock change depending on the state of the cam torque when the lock-release is started. The cam torque is changed in synchronization with the crank angle. Accordingly, to ensure the lock-release, it is necessary to start the lock-release at a crank angle at which the cam torque is in the state suitable for the lock-release.

In contrast, even if the ECU 20 supplies the duty command value of 100% to the OCV 16, and the application of the lock-release hydraulic pressure is commanded, a certain delay until the lock release hydraulic pressure is actually raised is observed due to a delay of the OCV 16 and a hydraulic pressure system. The time necessary to raise the hydraulic pressure is changed in accordance with the temperature of the oil. Accordingly, when the application of the lock-release hydraulic pressure is commanded at a certain crank angle, the crank angle at which the lock-release hydraulic pressure is raised is changed in accordance with the temperature of the oil.

When the temperature of the oil becomes high, the viscosity thereof is reduced so that the amount of discharge of the oil from the oil pump 14 is increased. As a result, the pressure of the oil in the main gallery 21 supplied for the application of the lock-release hydraulic pressure is increased. Accordingly, in the present embodiment, the temperature of the oil is grasped from the pressure of the oil in the main gallery 21, and the crank angle at which the application of the lock-release hydraulic pressure is commanded is set such that the lock-release hydraulic pressure is raised at an appropriate crank angle independent of the change of the time necessary to raise the hydraulic pressure in accordance with the temperature of the oil. Specifically, when it is considered that the pressure of the oil in the main gallery 21 is high and the temperature of the oil is high, the crank angle at which the application of the lock-release hydraulic pressure is commanded is retarded in comparison to the case where it is considered that the pressure of the oil is low, and the temperature of the oil is low.

Next, a process of lock-release control routine applied to the present embodiment will be described with reference to FIG. 1. The process of the present routine is performed by the ECU 20 after the engine has been started.

When the present routine is started, the condition of starting the variable valve timing control such that the engine rotation speed is increased to a prescribed value is waited in step S100. When the starting condition is established (step S100: YES), the pressure of the oil in the main gallery 21 at this time is read out in step S101.

Then, in step S102, the computation of a crank angle CCA at which the application of the lock-release hydraulic pressure is commanded is performed in accordance with the read out pressure of the oil in the main gallery 21. The computation of the crank angle CCA at this time is performed by using a computation map stored in the ECU 20 in advance. The computation map shows a correspondence relationship between the pressure of the oil in the main gallery 21 and the crank angle CCA.

In next step S103, the application of the lock-release hydraulic pressure is commanded to the OCV 16 at the computed crank angle CCA. According to the lock-release by the command, the variable valve timing control is started in accordance with the engine operation state (step S104).

Figure 2A:
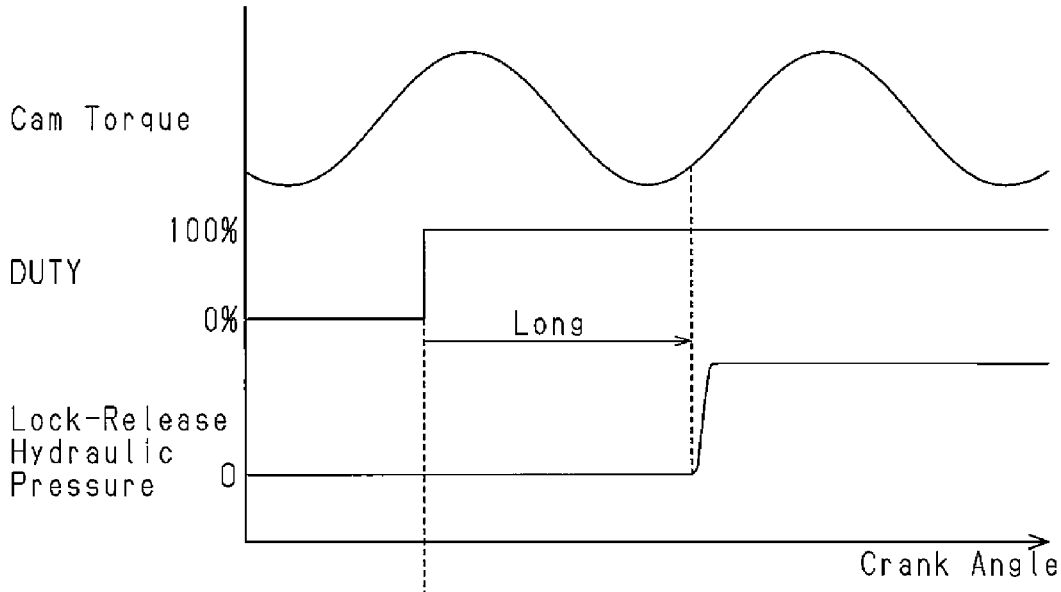
FIG. 2(*a*) is a time chart illustrating a control manner when the lock is released in the case where the oil temperature is high.
Figure 2B:
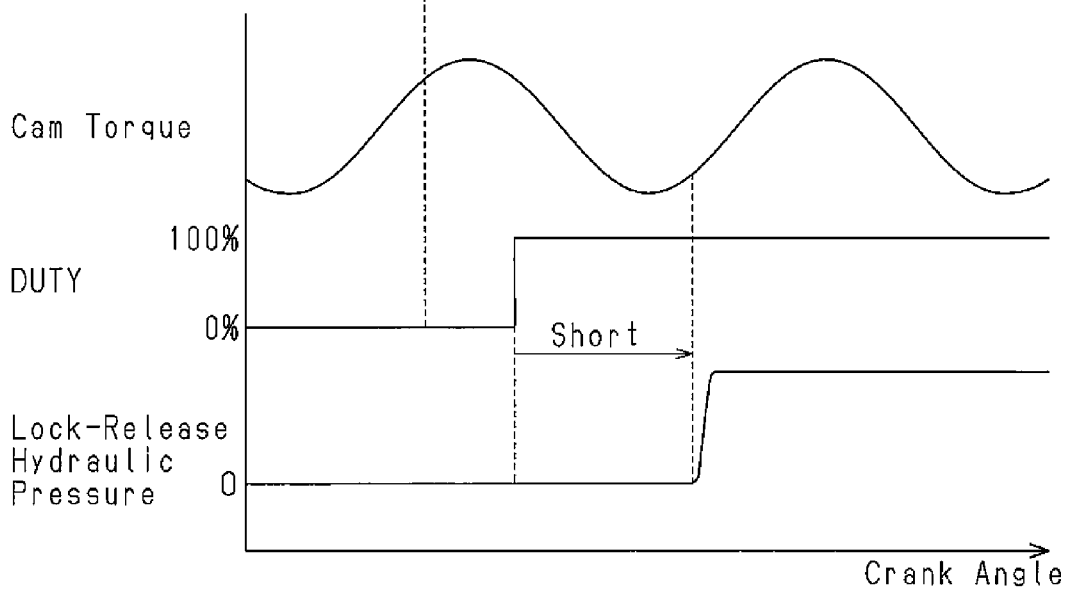
Figure 3:
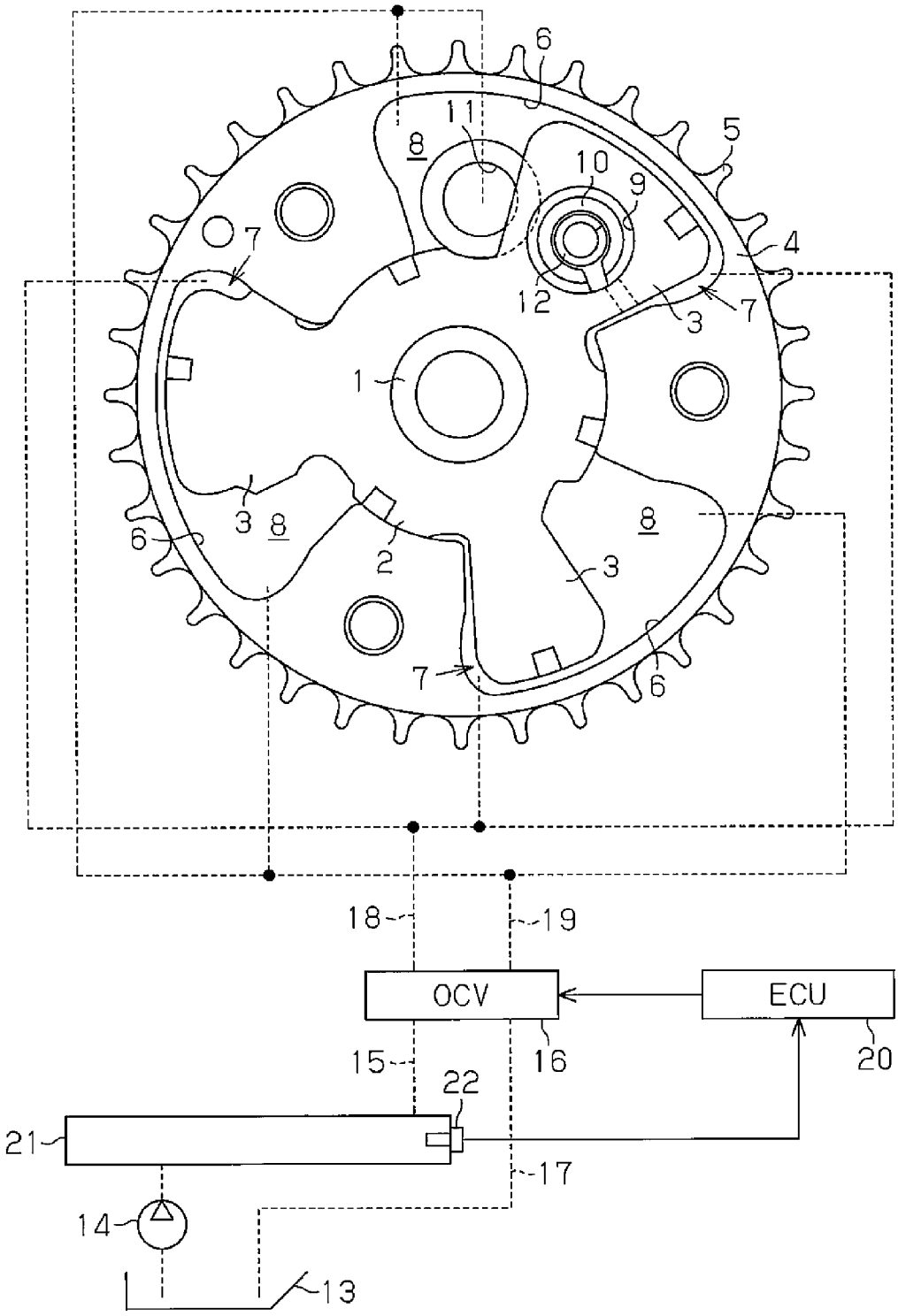
FIG. 3 is a diagram schematically illustrating a configuration of a conventional variable valve timing device.
Figure 4A:
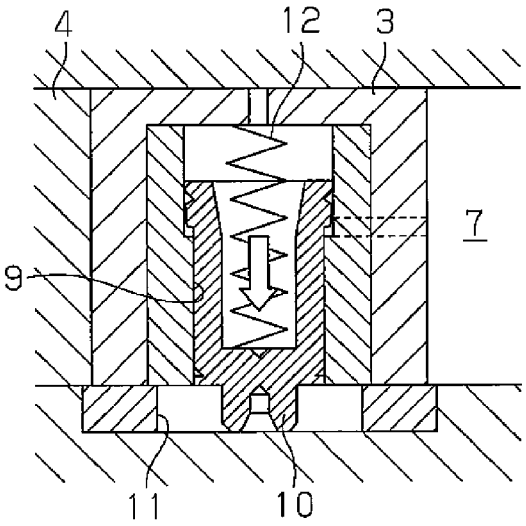
FIGS. 4(*a*) to 4(*c*) are cross-sectional views illustrating changes of the state of a lock mechanism when release failure is caused.
Figure 4B:
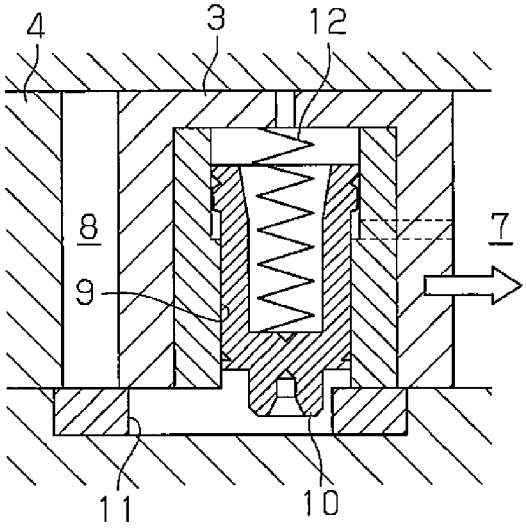
Figure 4C:
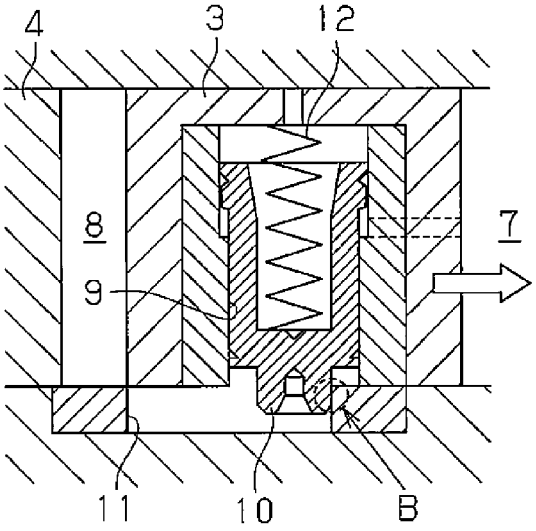

As shown in FIG. 2, in the above described present embodiment, when the temperature of the oil in the main gallery 21 is high and the pressure thereof is high, the crank angle at which the duty command value of 100% for commanding the application of the lock-release hydraulic pressure is supplied is retarded in comparison to the case where the temperature and the pressure of the oil are lower. As a result, the crank angle at which the lock-release hydraulic pressure is raised becomes substantially constant independent of the pressure and the temperature of the oil in the main gallery 21 supplied for the application of the lock-release hydraulic pressure, and the lock-release is started when the state of the cam torque becomes suitable for the lock-release.

The variable valve timing device of the present embodiment described above has the following advantage.

(1) According to the present embodiment, the crank angle CCA at which the application of the lock-release hydraulic pressure is commanded is set variably in accordance with the pressure of the oil in the main gallery 21 supplied for the application of the lock-release hydraulic pressure. Accordingly, even if the time necessary to raise the lock-release hydraulic pressure is changed because the temperature of the oil supplied for the application of the lock-release hydraulic pressure is changed, the crank angle CCA at which the application of the lock-release hydraulic pressure is commanded is set to start the lock-release at a crank angle at which the state of the cam torque becomes suitable for the lock-release. Therefore, according to the variable valve timing device of the present embodiment, the lock-release is ensured to be performed.

The above described embodiments may be modified as follows.

In the above described embodiments, the crank angle at which the application of the lock-release hydraulic pressure is commanded is set in accordance with the pressure of the oil in the main gallery 21. In the case where the temperature of the oil in the main gallery 21 is detected, the crank angle at which the application of the lock-release hydraulic pressure is commanded may be directly obtained from the temperature.

In the above described embodiments, the crank angle at which the application of the lock-release hydraulic pressure is commanded is set such that the lock-release hydraulic pressure is raised at a substantially constant crank angle independent of the temperature of the oil in the main gallery 21. In the case where the crank angle suitable for the lock-release includes a certain range, the crank angle at which the application of the lock-release hydraulic pressure is commanded may be set such that the crank angle at which the lock-release hydraulic pressure is raised is within the range.

In the case where a plurality of crank angles suitable for the lock-release are present, the crank angle at which the application of the lock-release hydraulic pressure is commanded may be set such that the lock-release hydraulic pressure is raised at any of the plurality of crank angles. For example, it is considered that the crank angle at which the application of the lock-release hydraulic pressure is commanded is set such that the lock-release hydraulic pressure is raised at a crank angle of the plurality of crank angles suitable for the lock-release, which reaches the earliest after the condition of starting the variable valve timing control has been established.

In the above described embodiments, the lock mechanism is configured to lock the vane rotor 2 when the vane rotor 2 is arranged at the most retarded position. The present invention may be similarly applied to a variable valve timing device in which a lock mechanism is configured to lock the vane rotor 2 at a position other than the most retarded position.

The configuration of the variable valve timing device, such as the number of the vanes 3, is not limited to that in the above described embodiments. The configuration may be changed as necessary. That is, the present invention may be applied to a variable valve timing device that varies the rotational phase of the camshaft through the relative rotation of the first and second rotary bodies and is provided with a lock mechanism that locks the rotary bodies to rotate integrally with each other, and releases the lock in response to the application of the lock-release hydraulic pressure.

In the above described embodiments, the variable valve timing device is configured such that the valve timing of the intake valve is set variably. The present invention may be similarly applied to a device in which the valve timing of an exhaust valve is set variably.

DESCRIPTION OF THE REFERENCE NUMERALS

1 . . . Camshaft, 2 . . . Vane Rotor, 3 . . . Vane, 4 . . . Housing, 5 . . . Cam Sprocket, 6 . . . Recess, 7 . . . Retard Chamber, 8 . . . Advance Chamber, 9 . . . Pin Hole, 10 . . . Lock Pin, 11 . . . Lock Hole, 12 . . . Spring, 13 . . . Oil Pan, 14 . . . Oil Pump, 15 . . . Supply Oil Passage, 16 . . . OCV, 17 . . . Drain Oil Passage, 18 . . . Retard Oil Passage, 19 . . . Advance Oil Passage, 20 . . . ECU, 21 . . . Main Gallery, and 22 . . . Oil Pressure Sensor.

The invention claimed is:

1. A variable valve timing device that varies a rotational phase of a camshaft through a relative rotation of a first rotary body and a second rotary body, the variable valve timing device comprising:

a lock mechanism, the lock mechanism being configured to (i) lock the first rotary body and the second rotary body such that the first rotary body and the second rotary body rotate integrally with each other, and (ii) release the lock in response to application of a lock-release hydraulic pressure; and an electronic control unit having control logic configured to cause the electronic control unit to:

determine, based on a crank angle, timing of commanding the application of the lock-release hydraulic pressure; and variably set the crank angle in accordance with a temperature of an oil supplied for the application.

2. The variable valve timing device according to claim 1, wherein the electronic control unit retards the crank angle at which the application of the lock-release hydraulic pressure is commanded when the temperature of the oil is high, as compared to when the temperature of the oil is low.

3. A variable valve timing device that sets a valve timing of an engine valve variably through a relative rotation of a first rotary body and a second rotary body, the variable valve timing device comprising:

a lock mechanism, the lock mechanism being configured to: (i) lock the first rotary body and the second rotary body such that the first rotary body and the second rotary body rotate integrally with each other, and (ii) release the lock in response to application of a lock-release hydraulic pressure; and an electronic control unit having control logic configured to cause the electronic control unit to:

determine, based on a crank angle, timing of commanding the application of the lock-release hydraulic pressure; and variably set the crank angle in accordance with a pressure of an oil supplied for the application.

4. The variable valve timing device according to claim 3, wherein the electronic control unit retards the crank angle at which the application of the lock-release hydraulic pressure is commanded when the pressure of the oil is high, as compared to when the pressure of the oil is low.

* * * * *